US010161213B2

(12) United States Patent
Boulanger

(10) Patent No.: US 10,161,213 B2
(45) Date of Patent: Dec. 25, 2018

(54) INTERNAL AND EXTERNAL PRESSURE SEAL ASSEMBLY

(71) Applicant: Cameron International Corporation, Houston, TX (US)

(72) Inventor: Bruce Boulanger, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 15/220,205

(22) Filed: Jul. 26, 2016

(65) Prior Publication Data

US 2018/0030804 A1 Feb. 1, 2018

(51) Int. Cl.
*E21B 33/064* (2006.01)
*E21B 33/038* (2006.01)
*E21B 33/00* (2006.01)

(52) U.S. Cl.
CPC ..... *E21B 33/064* (2013.01); *E21B 33/038* (2013.01); *E21B 2033/005* (2013.01)

(58) Field of Classification Search
CPC ..... E21B 33/064; E21B 33/038; E21B 33/005
See application file for complete search history.

(56) References Cited

U.S. PATENT DOCUMENTS 3,637,223 A * 1/1972 Weber ..... F16J 15/0887 277/608
3,749,426 A * 7/1973 Tillman, III ..... F16L 23/20 277/607
4,474,381 A * 10/1984 Wilkins ..... E21B 17/08 277/614
4,563,025 A * 1/1986 Poe ..... F16L 23/08 277/614
4,872,708 A * 10/1989 Abreo, Jr. ..... E21B 33/038 166/340
5,103,915 A 4/1992 Sweeney et al.
5,129,660 A * 7/1992 Taylor ..... E21B 33/03 166/196
5,839,765 A 11/1998 Carter et al.
6,044,904 A 4/2000 Shafer
6,409,176 B2 6/2002 Allen
6,561,521 B2 * 5/2003 Janoff ..... E21B 33/03 277/603
6,869,080 B2 * 3/2005 Janoff ..... E21B 33/03 277/603

(Continued)

FOREIGN PATENT DOCUMENTS

WO WO2005111403 11/2005

OTHER PUBLICATIONS

International Search Report and Written Opinion dated Oct. 17, 2017 in corresponding International Application No. PCT/US2017/043926; pp. 1-16.

*Primary Examiner* — Matthew R Buck
*Assistant Examiner* — Aaron L Lembo
(74) *Attorney, Agent, or Firm* — Helene Raybaud

(57) ABSTRACT

A system, method, and seal assembly for sealing between two devices. The system comprising a first device, a second device, and a seal assembly, which is configured to seal between the first device and the second device. The seal assembly comprises an annular gasket configured to seal against a pressure internal to the system. The seal assembly also comprises first and second annular seals positioned on the gasket and configured to seal against a pressure external to the system.

19 Claims, 4 Drawing Sheets

(56) References Cited

U.S. PATENT DOCUMENTS

| | | | | |
|---|---|---|---|---|
| 7,025,360 | B2 * | 4/2006 | Walker | E21B 33/03 277/627 |
| 7,467,663 | B2 | 12/2008 | Reimert | |
| 7,467,799 | B1 * | 12/2008 | Tarlton | F16J 15/0881 277/603 |
| 7,819,439 | B2 * | 10/2010 | Paton | E21B 17/02 277/314 |
| 8,226,089 | B2 * | 7/2012 | Pallini, Jr. | E21B 17/04 277/339 |
| 8,499,838 | B2 * | 8/2013 | Fraser | E21B 33/038 166/338 |
| 8,727,012 | B2 * | 5/2014 | Bhat | E21B 33/035 166/338 |
| 9,488,302 | B2 * | 11/2016 | Gjerstad | E21B 33/043 |
| 2003/0155721 | A1 * | 8/2003 | Zheng | F16J 15/0887 277/607 |
| 2007/0013146 | A1 * | 1/2007 | Gariepy | F16L 25/0018 277/608 |
| 2008/0048443 | A1 * | 2/2008 | Paton | E21B 17/02 285/333 |
| 2013/0175055 | A1 | 7/2013 | Hart et al. | |

* cited by examiner

INTERNAL AND EXTERNAL PRESSURE SEAL ASSEMBLY

BACKGROUND

This section is intended to provide background information to facilitate a better understanding of the various aspects of the described embodiments. Accordingly, it should be understood that these statements are to be read in this light and not as admissions of prior art.

In some subsea oil and gas well drilling and production assemblies, a connector connects two separate pieces of equipment. For example, a wellhead connector connects the wellhead to a blowout preventer (BOP) stack. A gasket can be seated between the connector and equipment to prevent the loss of pressure in a bore that runs through the wellhead and equipment. The external pressure applied to the gasket used in subsea drilling and production systems can exceed 5,000 psi (34 MPa) at depths of about 12,000 feet (3,657 m) below sea level. Additionally, in underbalanced drilling situations where the external pressure exceeds the internal bore pressure, the gasket needs to maintain its sealing integrity between the connector and equipment.

DESCRIPTION OF THE DRAWINGS

For a detailed description of the embodiments, reference will now be made to the accompanying drawings in which.

DETAILED DESCRIPTION

This disclosure describes a sealing mechanism for subsea equipment. Specifically, the subsea equipment is sealed with a seal assembly comprising a gasket with an annular seal to defend against pressure loss.

Figure 1:
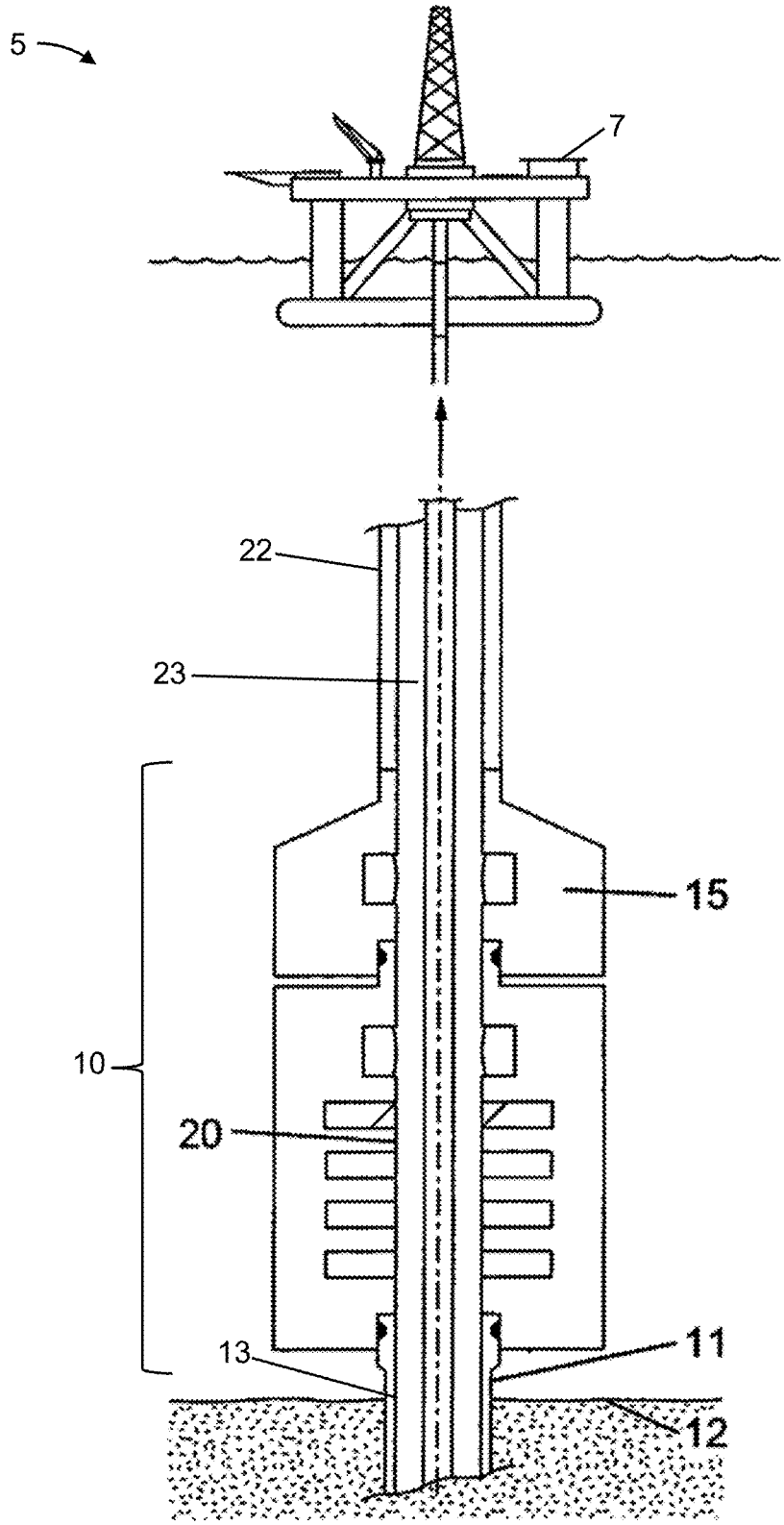
FIG. 1 shows a schematic diagram of a well system, according to one or more embodiments.

FIG. 1 schematically depicts an example well system 5 in accordance with one or more embodiments. As shown, the well system 5 includes an offshore vessel 7, a blowout preventer (BOP) stack assembly 10, and a wellhead assembly 11. In particular, the wellhead assembly 11 is located at the upper end of a wellbore 13 that intersects the earth surface or seabed 12. The lower end of the BOP stack assembly 10 is connected to the upper end of the wellhead assembly 11 and is sealed in place as will be described in further detail below. A marine riser string 22 is connected to a lower marine riser package (LMRP) 15 to place the BOP stack assembly 10 in fluid communication with the offshore vessel 7, for example a floating production storage and offloading (FPSO) unit, platform, floating platform, or the like. A bore 20 extends through the riser string 22 and the BOP stack assembly 10 to be in fluid communication with the wellbore 13.

A tubular string 23 is located within the bore 20 of the BOP stack assembly 10 and riser string 22. The tubular string 23 may incorporate a number of different types of components, including simple piping, joint members, and/or bore guidance equipment, and may have attached at its lower end additional components, for example a test tool, a drill bit, or a simple device which allows the circulation or the flow of desired fluids through the well. Alternatively, the tubular string 23 may include casing string, tubing string, coiled tubing, wire line, cables, or other components which are necessary to pass through the BOP stack assembly 10 and into the wellhead assembly 11.

Figure 2:
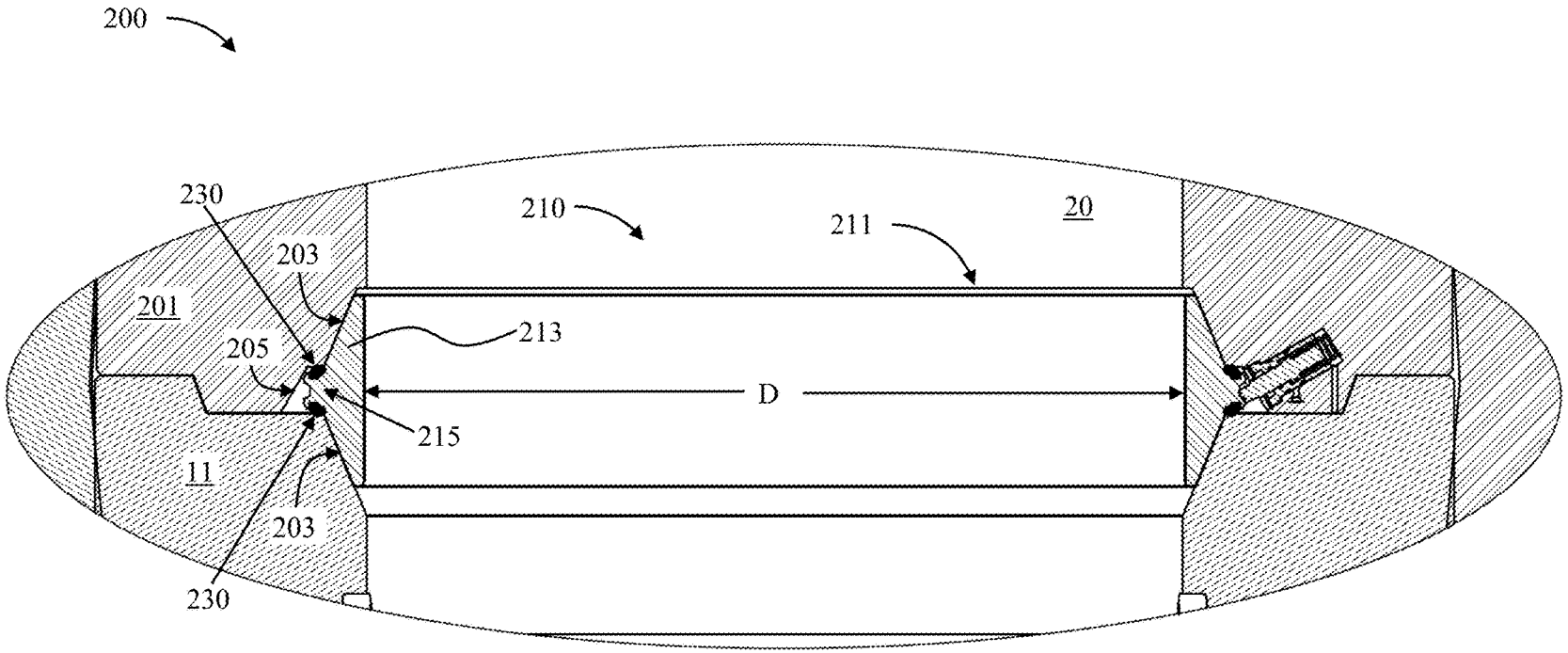
FIG. 2 shows a cross-section view of a system for sealing a bore between a connector and a piece of subsea equipment, according to one or more embodiments.

FIG. 2 shows a cross-section of a system 200 for sealing a bore 20 between a first device, such as a wellhead connector 201, and a second device, such as wellhead assembly 11, in accordance with one or more embodiments. As shown, the wellhead connector 201 can include any suitable wellhead connector designed to provide a connection between the BOP stack assembly 10 and the wellhead assembly 11. A seal assembly 210 is located between the connector 201 and the wellhead assembly 11 to seal between the bore 20 and the subsea environment outside the wellhead assembly 11 and connector 201 to prevent pressure loss from the bore 20. It should be appreciated that although the embodiment discusses examples of a wellhead connector and a wellhead assembly 11, other subsea devices may be sealed together using the seal assembly 210 as well.

As illustrated, the seal assembly 210 includes an annular gasket 211 with at least two annular seals 230 coupled around the gasket 211. In particular, the gasket 211 includes a base 213 with tapered surfaces 203 tapering in a radially outward direction that are designed to conform to corresponding tapered faces of the connector 201 and the wellhead assembly 11. The tapered surfaces 203 seal against the connector 201 and the wellhead assembly 11 to prevent fluid communication from the bore 20 out to the environment external to the wellhead assembly 11 during situations where the internal pressure of the system 200 is greater than the external pressure (e.g., a hydrostatic pressure), such as during overbalanced drilling situations. The gasket 211 also includes a rib 215 around the outside of the base 213 that extends radially outward from the outer circumference of the base 213 into a recess 205 between the connector 201 and the wellhead assembly 11. The gasket 211 includes an inner diameter D that matches the inner diameter of the bore 20. In one or more embodiments, the inner diameter D is about 18¾ inches (47 cm). The gasket 211 may be formed from any suitable material for sealing between the devices 201 and 11. In one or more embodiments, the gasket 211 may be formed from a metallic material, such as a steel alloy.

Figure 4:
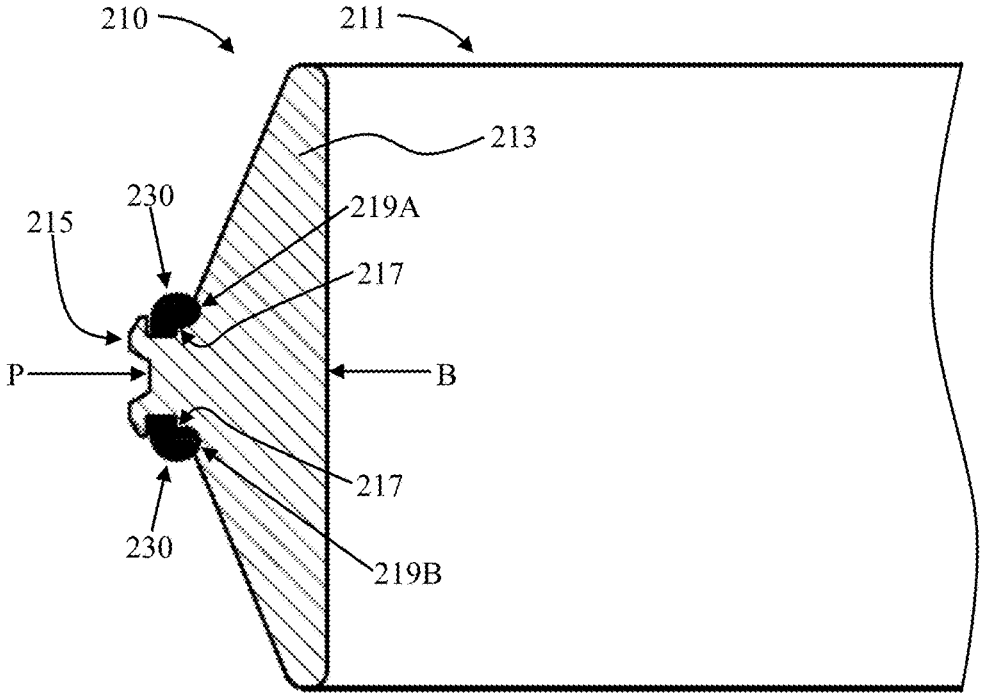
Figure 5:
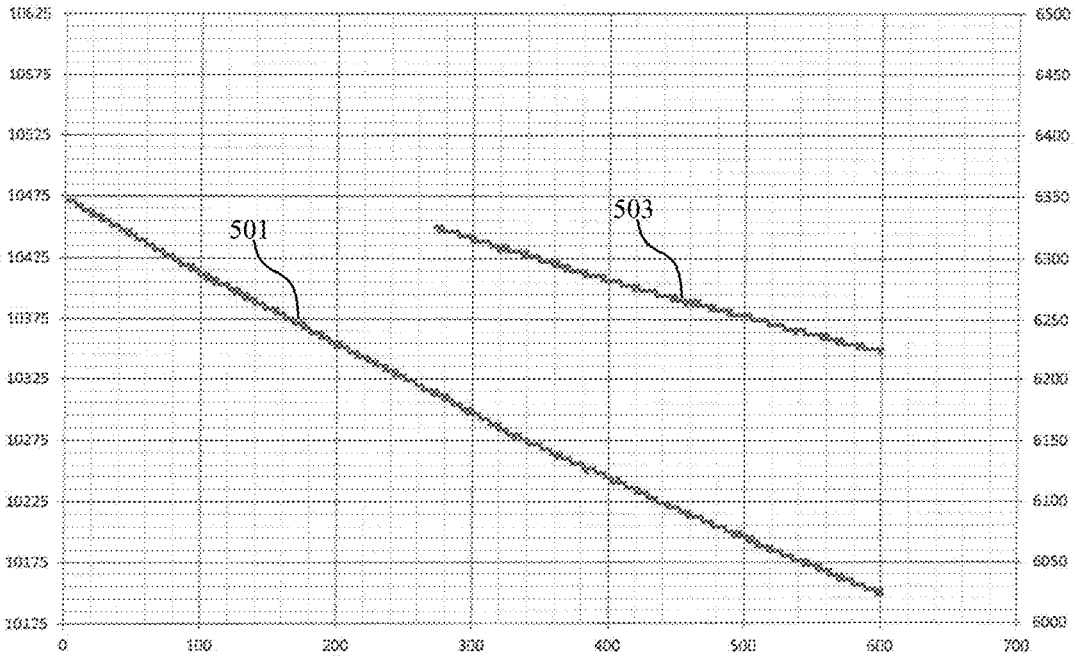
FIG. 5 shows a graph of external and internal pressures encountered by the gasket assembly of FIG. 2, according to one or more embodiments.

FIGS. 4 and 5 show fragmentary cross-sections of the seal assembly 210 for sealing the connector 201 to the wellhead assembly 11, according to one or more embodiments. As shown in FIG. 4, the gasket 211 includes grooves 219A, 219B for receiving the annular seals 230 (FIG. 2) that are located at interfaces 217 between the base 213 and the rib 215. Each groove 219A, 219B includes a profile 221 adapted to receive at least a portion of one of the seals 230 (FIG. 2). Each profile 221 extends over a portion of one or both the base 213 and the rib 215 to create a sealing surface for one of the seals 230 in a radially inward direction. As a non-limiting example, the profiles 221 may be formed by machining annular recesses into the base 213 and/or the rib 215.

Referring to FIG. 5, the annular seals 230 are shaped to be received within the grooves 219. As shown, each seal 230 may have a P-shaped profile that matches a profile 221 (FIG. 4) of the grooves 219A, 219B. It should be appreciated that the seals 230 may be made of any suitable sealing material, such as elastomeric materials or any other elastic, sealing material. The seals 230 are positioned in the grooves 219A, 219B and seal against the profiles 221 to prevent fluid communication from the environment external to the wellhead assembly 11 into the bore 20 during situations where the external pressure is greater than an internal pressure of the system 200, e.g., an underbalanced drilling situation. Thus, the combination of the sealing by the base 213 and the sealing by the annular seals 230 allows the seal assembly 210 to seal against pressure differentials between internal and external pressures in both directions.

In one or more embodiments, the seal assembly 210 can maintain its seal at an external pressure up to about 5,500 psi (37 MPa), which corresponds to a pressure encountered at about 12,000 feet (3,657 m) below sea level. As used herein, the external pressure refers to a pressure encountered outside the wellhead assembly 11 at a subsea location, such as a hydrostatic pressure at the seabed, and transferred to the external surfaces of the seal assembly 210 in a direction indicated by the arrow P. Further, the seal assembly 210 can maintain its seal at an internal pressure within the bore 20 up to about 15,000 psi (103 MPa). As used herein, the internal pressure refers to the pressure exerted within the bore 20 in a direction indicated by arrow B. Additionally, or alternatively, the seal assembly 210 can maintain its seal during underbalanced drilling situations. As used herein, the seal assembly 210 is described as maintaining its seal if the seal assembly 210 is secure against leakage and contains the internal pressure.

Figure 3:
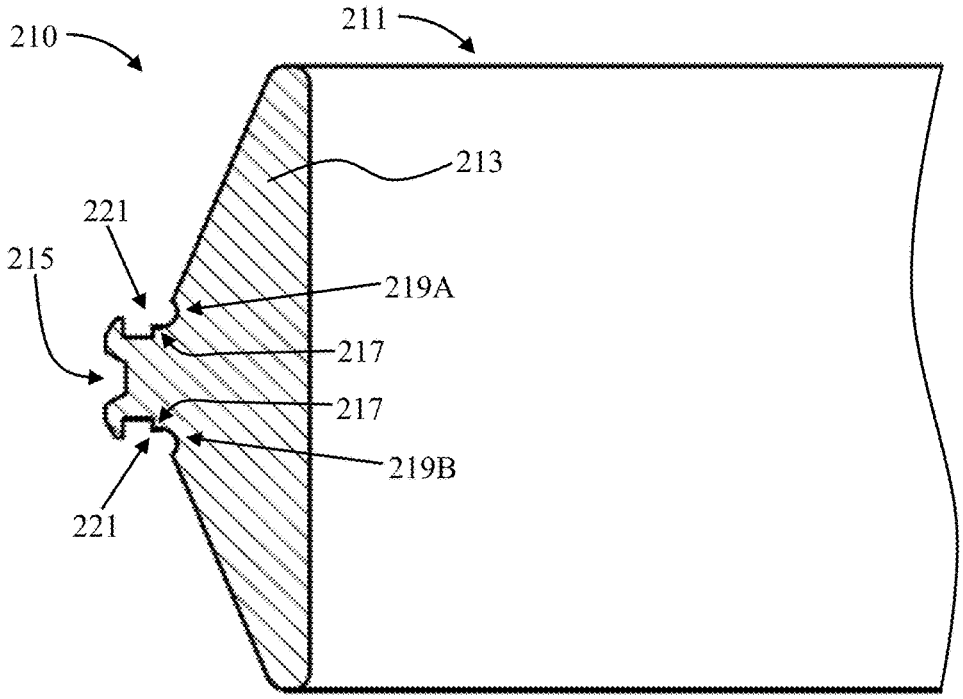
FIGS. 3 and 4 show a fragmentary cross-section view of the gasket assembly of FIG. 2, according to one or more embodiments.

In one or more embodiments, the grooves 219A, 219B and profiles 221 may be different shapes than the shapes illustrated in FIG. 3 with correspondingly differently shaped annular seals 230 than the shapes illustrated in FIG. 4. Additionally, or alternatively, the groove 219A may have a different profile 221 than the groove 219B with correspondingly differently shaped annular seals 230.

FIG. 5 shows a graph of the external and internal pressures encountered by the seal assembly 210 during laboratory testing, in accordance with one or more embodiments. The left ordinate indicates the pressure in pounds per square inch (psi) for the internal pressure of the bore 20 (e.g., the arrow B of FIG. 4); and the right ordinate indicates the pressure in pounds per square inch (psi) for the external pressure encountered by the gasket assembly 210 (e.g., the arrow P of FIG. 4). The abscissa indicates the amount of time in seconds that the seal assembly 210 was subjected to the pressures as indicated by the curves 501, 503. In particular, the curve 501 shows the external pressure encountered by the seal assembly 210, and the curve 503 shows the internal pressure encountered by the seal assembly 210.

It will be appreciated that the seal assembly 210 is not limited to sealing a wellhead connector to a wellhead assembly. In one or more embodiments, the seal assembly 210 can be coupled between opposing ends of two tubular devices that may experience internal pressures up to 15,000 psi (103 MPa), external pressure up to 5,500 psi (37 MPa), and underbalanced pressure situations.

This discussion is directed to various embodiments of the disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A system, comprising:

a first device;

a second device; and a seal assembly configured to seal between the first device and the second device, the seal assembly comprising:

an annular gasket configured to seal against a pressure internal to the system;

first and second annular seals positioned on the gasket and configured to seal against a pressure external to the system;

wherein the gasket comprises an annular base including:

tapered surfaces;

a rib extending radially outward from the tapered surfaces such that there is a first interface between the rib and a first tapered surface of the tapered surfaces; and a first groove at the first interface comprising a first profile comprising a first annular recess formed in and extending over a portion of the first tapered surface and a second annular recess formed in and extending over a portion of the rib;

wherein at least a portion of the first annular seal is positioned in the first annular recess and another portion of the first annular seal is positioned in the second annular recess.

2. The system of claim 1, wherein the first annular seal is sealed against the first profile to seal against pressure external to the system when an internal system pressure is below the external pressure.

3. The system of claim 1, further comprising:

a second interface between the rib and a second tapered surface of the tapered surfaces; and a second groove at the second interface comprising a second profile comprising a third annular recess formed in and extending over a portion of the second tapered surface and a fourth annular recess formed in and extending over a portion of the rib;

wherein at least a portion of the second annular seal is positioned in the third annular recess and another portion of the second annular seal is positioned in the fourth annular recess.

4. The system of claim 3, wherein the first groove and the second groove comprise different profiles.

5. The system of claim 1, wherein the first annular seal comprises a respective profile corresponding to the first profile so as to seal against a portion of the first groove.

6. The system of claim 1, wherein one of the first or second device comprises a subsea blowout preventer.

7. The system of claim 1, wherein the seal assembly is configured to withstand an internal pressure of up to 15,000 psi (103 MPa) and an external pressure of up to 5,500 psi (37 MPa).

8. The system of claim 1, wherein the first annular recess comprises a first cross-sectional shape and the second annular recess comprises a second cross-sectional shape, different from the first cross-sectional shape, and the first and second cross-sectional shapes are taken within a plane parallel to a central axis of the gasket.

9. The system of claim 1, wherein the first annular seal comprises a P-shaped cross-sectional shape when positioned in the first annular recess and the second annular recess.

10. A seal assembly for sealing between two devices when located subsea, the seal assembly being configured to couple between the two devices, comprising:

an annular gasket configured to seal against a pressure internal to the two devices;

first and second annular seals positioned on the annular gasket and configured to seal against pressure external to the two devices, wherein the annular gasket comprises an annular base including:

tapered surfaces;

a rib extending radially outward from the tapered surfaces such that there is a first interface between the rib and a first tapered surface of the tapered surfaces; and a first groove at the first interface comprising a first profile extending over a portion of the first tapered surface and extending over a first portion of the rib;

wherein at least a portion of the first annular seal is positioned in a first portion of the first profile extending over the portion of the first tapered surface and another portion of the first annular seal is positioned in a second portion of the first profile extending over the first portion of the rib.

11. The seal assembly of claim 10, wherein the first annular seal is sealed against the first profile to seal against pressure external to the two devices when the internal pressure is below the external pressure.

12. The seal assembly of claim 10, further comprising:

a second interface between the rib and a second tapered surface of the tapered surfaces; and a second groove at the second interface comprising a second profile extending over a portion of the second tapered surface and extending over a second portion of the rib;

wherein at least a portion of the second annular seal is positioned in a first portion of the second profile extending over the portion of the second tapered surface and another portion of the second annular seal is positioned in a second portion of the second profile extending over the second portion of the rib.

13. The seal assembly of claim 12, wherein the first groove and the second groove comprise different profiles.

14. The system of claim 10, wherein the first annular seal comprises a respective profile corresponding to the first profile so as to seal against a portion of the first groove.

15. The system of claim 10, wherein one of the two devices comprises a subsea blowout preventer.

16. The system of claim 10, wherein the seal assembly is configured to withstand an internal pressure of up to 15,000 psi (103 MPa) and an external pressure of up to 5,500 psi (37 MPa).

17. The system of claim 10, wherein the first profile comprises a first annular recess extending over the portion of the first tapered surface and a second annular recess extending over the first portion of the rib.

18. A method, comprising:

sealing a first device to a second device at a subsea location using a seal assembly comprising an annular seal and a gasket;

wherein the seal assembly seals against fluid communication from outside the first and second devices when a pressure internal to the first and second devices is below a pressure external to the first and second devices;

wherein the seal assembly seals against fluid communication from inside the first and second devices when the internal pressure is above the external pressure;

wherein the gasket comprises an annular base including:

tapered surfaces;

a rib extending radially outward from the tapered surfaces such that there is an interface between the rib and a first tapered surface of the tapered surfaces; and an annular groove at the interface comprising a profile extending over a portion of the first tapered surface and extending over a portion of the rib;

wherein at least a portion of the annular seal is positioned in a first portion of the profile extending over the portion of the first tapered surface and another portion of the annular seal is positioned in a second portion of the profile extending over the portion of the rib.

19. The method of claim 18, wherein the profile comprises a first annular recess extending over the portion of the first tapered surface and a second annular recess extending over the portion of the rib.

* * * * *